US010094002B2

(12) United States Patent
Miura et al.

(10) Patent No.: US 10,094,002 B2
(45) Date of Patent: Oct. 9, 2018

(54) CU—BE ALLOY AND METHOD FOR PRODUCING SAME

(71) Applicants: NGK Insulators, Ltd., Nagoya (JP); The University of Electro-Communications, Chofu (JP)

(72) Inventors: Hiromi Miura, Machida (JP); Naokuni Muramatsu, Nagoya (JP)

(73) Assignees: NGK Insulators, Ltd., Nagoya (JP); The University of Electro-Communications, Chofu (JP)

( * ) Notice: Subject to any disclaimer, the term of this patent is extended or adjusted under 35 U.S.C. 154(b) by 581 days.

(21) Appl. No.: 14/693,120

(22) Filed: Apr. 22, 2015

(65) Prior Publication Data

US 2015/0225817 A1 Aug. 13, 2015

Related U.S. Application Data

(63) Continuation of application No. PCT/JP2013/078695, filed on Oct. 23, 2013.

(30) Foreign Application Priority Data

Nov. 2, 2012 (JP) ..... 2012-242498

(51) Int. Cl.
*C22C 9/00* (2006.01)
*C22F 1/08* (2006.01)
(Continued)

(52) U.S. Cl.
CPC ..... *C22C 9/00* (2013.01); *C22F 1/08* (2013.01); *H01B 1/026* (2013.01); *H01B 13/0016* (2013.01); *C22F 1/00* (2013.01)

(58) Field of Classification Search
None
See application file for complete search history.

(56) References Cited

U.S. PATENT DOCUMENTS 4,425,168 A 1/1984 Goldstein et al.
4,792,365 A * 12/1988 Matsui ..... C22C 9/00 148/432
(Continued)

FOREIGN PATENT DOCUMENTS

CN 102181744 A 9/2011
CN 102719699 A 10/2012
(Continued)

OTHER PUBLICATIONS

Sakai et al., "Effect of small amount addition of Co on Dynamic Recrystallization of Cu—Be alloys", Materials Transactions, JIM, vol. 36, No. 8, 1995, p. 1023-1030.*
(Continued)

*Primary Examiner* — Devang R Patel
(74) *Attorney, Agent, or Firm* — Burr & Brown, PLLC

(57) ABSTRACT

A Cu—Be alloy according to the present invention is a Co-containing Cu—Be alloy, in which the Co content is 0.005% to 0.12% by mass, and the number of Cu—Co-based compound particles having a particle size of 0.1 μm or more that can be confirmed on a TEM image at a magnification of 20,000 is five or less in a field of view of 10 μm×10 μm. Furthermore, a method for producing a Cu—Be alloy according to the present invention includes a solution annealing treatment step of subjecting a Cu—Be alloy raw material containing 0.005% to 0.12% by mass of Co and 1.60% to 1.95% by mass of Be to solution annealing treatment to obtain a solution-annealed material.

13 Claims, 3 Drawing Sheets

(51) Int. Cl.

| | |
|---|---|
| ***H01B 1/02*** | (2006.01) |
| ***H01B 13/00*** | (2006.01) |
| *C22F 1/00* | (2006.01) |

(56) References Cited

U.S. PATENT DOCUMENTS

| | | | | |
|---|---|---|---|---|
| 5,651,844 | A * | 7/1997 | Longenberger | C22F 1/08 148/683 |
| 5,824,167 | A * | 10/1998 | Ishikawa | C22C 9/00 148/435 |
| 2013/0048162 | A1* | 2/2013 | Ito | C22F 1/08 148/684 |

FOREIGN PATENT DOCUMENTS

| | | | |
|---|---|---|---|
| JP | 48-87395 | A1 | 11/1973 |
| JP | 48-87396 | A1 | 11/1973 |
| JP | 49-29047 | B1 | 8/1974 |
| JP | 50-32019 | A1 | 3/1975 |
| JP | 03-294462 | A1 | 12/1991 |
| JP | 07-13283 | B2 | 2/1995 |
| JP | 2827102 | B2 | 11/1998 |
| JP | 2008-297617 | A | 12/2008 |

OTHER PUBLICATIONS

Miki et al., "Effects of Co, Ni, and Ti Additions on the Cellular precipitation in Cu-2%Be Alloy", Materials Transactions, JIM, vol. 35, No. 3, 1994, p. 161-167.*

Chinese Office Action, Chinese Application No. 201380056659.2, dated Mar. 2, 2016 (7 pages).

Extended European Search Report, European Application No. 13852279.2, dated Jul. 11, 2016 (12 pages).

Takuichi Morinaga, et al., Journal of the Japan Institute of Metals, 1960, vol. 24, No. 12, pp. 777-781.

Mishima and Okubo, "*Effect of Co, Fe, Si and Al on the Ageing Characteristics of High Purity Cu—Be-Alloy*," Journal of Japan Copper and Brass Association, 1966, vol. 5, No. 1, pp. 112-118.

Harusige Tsubakino et al., "*The Influence of Cobalt Content on the Volume Fraction of Discontinuous Precipitation Cellsin Cu-2 wt%Be—Co Alloys*," Journal of the Japan Institute of Metals, 1980, vol. 44, No. 10, pp. 1122-1126.

International Search Report and Written Opinion (Application No. PCT/JP2013/078695) dated Jan. 21, 2014.

* cited by examiner

CU—BE ALLOY AND METHOD FOR PRODUCING SAME

BACKGROUND OF THE INVENTION

1. Field of the Invention

The present invention relates to a Cu—Be alloy and a method for producing the same.

2. Description of the Related Art

Hitherto, Cu—Be alloys have been widely used as practical alloys exhibiting both high strength and high electrical conductivity for electronic components and mechanical parts. Such Cu—Be alloys are obtained, for example, by a method in which, after melting and casting, hot- or cold-plastic working and annealing treatment are repeated, and then solution annealing treatment, cold working, and age hardening treatment are performed in this order (refer to Patent Literature 1 and 2). In age hardening treatment of Cu—Be alloys, in some cases, Cu—Be compounds may be discontinuously precipitated in grain boundaries by a grain boundary reaction, which may result in decreased mechanical strength. In order to suppress decreased mechanical strength, addition of Co has been proposed (refer to Non Patent Literature 1 to 3). By adding Co, the grain boundary reaction during age hardening treatment and discontinuous precipitation of Cu—Be compounds in grain boundaries can be suppressed. Furthermore, by adding Co, it is possible to prevent coarsening of crystal grains during casting, hot working, annealing, solution annealing treatment, and the like.

CITATION LIST

Patent Literature

PTL 1: Japanese Patent No. 07-13283

PTL 2: Japanese Patent No. 2827102

Non Patent Literature

NPL 1: Morinaga, Goto, and Takahashi; J. Japan Inst. Metals, Vol. 24, No. 12(1960), pp. 777-781

NPL 2: Mishima and Okubo; Journal of Japan Copper and Brass Association, Vol. 5, No. 1(1966), pp. 112-118

NPL 3: Tsubakino, Nozato, and Mitani; J. Japan Inst. Metals, Vol. 44, No. 10(1980), pp, 1122-1126

SUMMARY OF INVENTION

Technical Problem

However, in Cu—Be alloys to which Co is added, mechanical strength remains insufficient, and it is desirable to further increase mechanical strength.

The present invention has been achieved in view of such a technical problem, and it is a main object of the present invention to provide a Cu—Be alloy in which mechanical strength can be increased and a method for producing the same.

Solution to Problem

In order to achieve the object described above, the present inventors have produced a Cu—Be alloy which contains 0.12% by mass or less of Co, in which the number of Cu—Co-based compound particles having a particle size of 0.1 μm or more that can be confirmed on a TEM image at a magnification of 20,000 is five or less in a field of view of 10 μm×10 μm. It has been found that, when the Cu—Be alloy is subjected to strong working under cold conditions, followed by age hardening treatment, mechanical strength can be increased. Thus, the present invention has been completed.

That is, a Cu—Be alloy according to the present invention is a Co-containing Cu—Be alloy, in which the Co content is 0.005% to 0.12% by mass, and the number of Cu—Co-based compound particles having a particle size of 0.1 μm or more that can be confirmed on a TEM image at a magnification of 20,000 is five or less in a field of view of 10 μm×10 μm.

Furthermore, a method for producing a Cu—Be alloy according to the present invention includes a solution annealing treatment step of subjecting a Cu—Be alloy raw material containing 0.005% to 0.12% by mass of Co and 1.60% to 1.95% by mass of Be to solution annealing treatment to obtain a solution-annealed material.

Advantageous Effects of Invention

According to the present invention, it is possible to provide a Cu—Be alloy in which mechanical strength can be increased and a method for producing the same. The reason for this can be assumed as follows. In an existing Cu—Be alloy, since coarse Cu—Co-based compound particles are interspersed, the Cu—Co-based compound particles act as starting points for fracture, and sufficient mechanical strength cannot be obtained. In fact, when a fracture surface of the existing Cu—Be alloy added with Co is confirmed, the presence of coarse Cu—Co-based compound particles is confirmed. In contrast, in the present invention, since substantially no coarse Cu—Co-based compound particles that act as starting points for fracture are present, it is assumed that it is possible to suppress a decrease in mechanical strength, such as tensile strength.

DESCRIPTION OF EMBODIMENTS

Figure 1A:
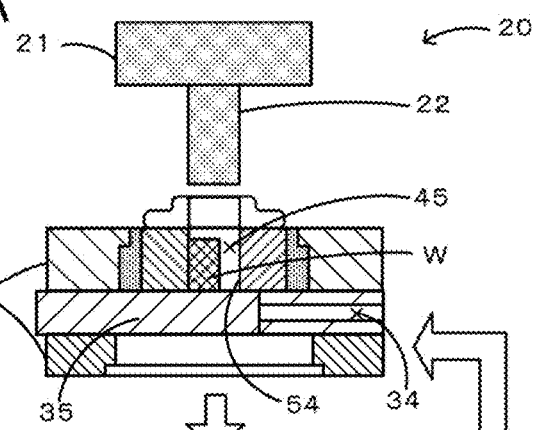
FIG. 1A, FIG. 1B, FIG. 1C and FIG. 1D include explanatory views showing an example of a forging method.
Figure 1A:
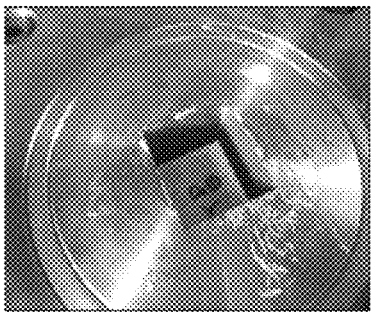

A Cu—Be alloy according to the present invention is a Co-containing Cu—Be alloy. The Co content is 0.005% to 0.12% by mass, and may be 0.005% by mass or more and less than 0.05% by mass. When the Co content is 0.005% by mass or more, it is possible to obtain an effect of addition of Co, i.e., an effect of suppressing discontinuous precipitation of Cu—Be compounds in grain boundaries or preventing coarsening of crystal grains. Furthermore, when the Co content is 0.12% by mass or less, since substantially no coarse Cu—Co-based compound particles are present, mechanical strength can be increased. The Be content is not particularly limited, but is preferably 1.60% to 1.95% by mass, and more preferably 1.85% to 1.95% by mass. The reason for this is that when the Be content is 1.60% by mass or more, the effect of increasing mechanical strength by means of age hardening treatment can be anticipated, and when the Be content is 1.95% by mass or less, coarse Cu—Co-based compound particles are unlikely to be generated.

In the Cu—Be alloy, the number of Cu—Co-based compound particles having a particle size of 0.1 μm or more that can be confirmed on a TEM image at a magnification of 20,000 is five or less in a field of view of 10 μm×10 μm. In such an alloy, since the percentage of presence of Cu—Co-based compound particles having a particle size of 0.1 μm or more that can be starting points for fracture is low, mechanical strength can be increased. Here, the number of Cu—Co-based compound particles having a particle size of 0.1 μm or more that can be confirmed on a TEM image at a magnification of 20,000 may be five or less, preferably four or less, and more preferably three or less. Particularly preferably, the number of Cu—Co-based compound particles having a particle size of 0.1 μm or more and less than 1 μm that can be confirmed on the TEM image is five or less in a field of view of 10 μm×10 μm. Furthermore, regarding the Cu—Co-based compound particles having a particle size of 0.1 μm or more that can be confirmed on a TEM image at a magnification of 20,000, the average particle size is preferably less than 0.9 μm, more preferably 0.5 μm or less, and still more preferably 0.3 μm or less. The reason for this is that as the average particle size decreases, the particles are less likely to act as starting points for fracture. In the preset invention, when a small piece including a cross section along the rolling direction or a cross section along the final forging direction is cut out and the small piece is formed into a thin film, the particle size is expressed by the formula: particle size $(D)=(D_L+D_S)/2$, where $D_L$ is the length of the major axis and $D_S$ is the length of the minor axis of a particle confirmed by TEM observation of the thin film. Furthermore, the average particle size is defined as the value obtained by dividing the sum of particle sizes by the number of Cu—Co-based compound particles whose particle size is measured.

In the Cu—Be alloy, preferably, Cu—Co-based compound particles having a particle size of 1 μm or more are not observed on the TEM image, and more preferably, Cu—Co-based compound particles having a particle size of 1 μm or more are not present. In such an alloy, since substantially no Cu—Co-based compound particles having a particle size of 1 μm or more that often act as starting points for fracture are present, mechanical strength can be increased.

The Cu—Be alloy may be a solution-annealed material as subjected to solution annealing treatment (before cold working which will be described later). The solution annealing treatment is a treatment for obtaining a solution-annealed material in which Be (or Be compounds) and Co (or Co compounds) are dissolved in the Cu matrix. A method for solution annealing treatment will be described later, and therefore, a specific explanation will be omitted here. Although the solution-annealed material as it is has relatively low strength, the strength can be increased by subsequent working, heat treatment, or the like. In the solution-annealed material, the number of Cu—Co-based compound particles having a particle size of 0.1 μm or more that can be confirmed on a TEM image at a magnification of 20,000 is five or less in a field of view of 10 μm×10 μm. Consequently, during subsequent working, it is possible to suppress fracture or the like originating from Cu—Co-based compound particles, and the alloy can endure strong working or the like for further increasing the strength.

The Cu—Be alloy may be obtained by subjecting the solution-annealed material to cold working, followed by age hardening treatment. The Cu—Be alloy obtained through such treatment has high mechanical strength. Examples of the cold working include strong working under cold conditions, such as cold rolling at a rolling reduction of 90% or more or cold forging at a cumulative strain $\Sigma\Delta\varepsilon$ of 2.0 or more. A method for cold working will be described later, and therefore, a specific explanation will be omitted here. A method for age hardening treatment will also be described later, and a specific explanation will be omitted here. In the age hardening treatment, preferably, the material is held for 15 minutes to 4 hours in the temperature range of 250° C. to 350° C. Furthermore, instead of the solution-annealed material, a non-solution-annealed material which has not been subjected to solution annealing treatment may be used. However, use of the solution-annealed material is preferable. The reason for this is that in the case where the solution-annealed material is used, a state of supersaturated solid solution of Be atoms can be formed, larger amounts of Cu—Be compounds can be precipitated in the crystal grains by the subsequent age hardening treatment, which is advantageous in increasing the strength.

In the Cu—Be alloy, for example, tensile strength can be set at 1,700 MPa or more. In particular, in a Cu—Be alloy obtained through cold rolling at a rolling reduction of 90% or more or cold forging at a cumulative strain $\Sigma\Delta\varepsilon$ of 2.0 or more, it is easy to set the tensile strength at 1,700 MPa or more, and in a Cu—Be alloy obtained through cold forging at a cumulative strain $\Sigma\Delta\varepsilon$ of 2.4 or more, it is easy to set the tensile strength at 1,900 MPa or more. Furthermore, in the Cu—Be alloy, elongation at break can be set, for example, at 1.5% or more. In particular, in a Cu—Be alloy obtained through cold rolling at a rolling reduction of 90% or more, it is easy to set the elongation at break at 4% or more, and in a Cu—Be alloy obtained through cold forging at a cumulative strain $\Sigma\Delta\varepsilon$ of 2.0 or more, it is easy to set the elongation at break at 1.5% or more.

A method for producing a Cu—Be alloy according to the present invention includes a solution annealing treatment step of subjecting a Cu—Be alloy raw material containing 0.005% to 0.12% by mass of Co and 1.60% to 1.95% by mass of Be to solution annealing treatment to obtain a solution-annealed material. In such a method for producing a Cu—Be alloy, it is possible to easily produce a Cu—Be alloy in which the number of Cu—Co-based compound particles having a particle size of 0.1 μm or more that can be confirmed on a TEM image at a magnification of 20,000 is five or less in a field of view of 10 μm×10 μm.

The method for producing a Cu—Be alloy may include (1) a melting and casting step, (2) a homogenizing treatment step, (3) a pre-working step, (4) a solution annealing treatment step, (5) a cold working step, and (6) an age hardening treatment step.

(1) Melting and Casting Step

In this step, a raw material having a composition including 1.60% to 1.95% by mass of Be, 0.005% to 0.12% by mass of Co, and the balance being Cu and incidental impurities is melted and cast to produce an ingot. When such a raw material composition is used, it is possible to more easily obtain a Cu—Be alloy in which the number of Cu—Co-based compound particles having a particle size of 0.1 μm or more that can be confirmed on a TEM image at a magnification of 20,000 is five or less in a field of view of 10 μm×10 μm. The melting method is not particularly limited. A commonly used method, such as a high-frequency induction melting method, a low-frequency induction melting method, an arc melting method, or an electron beam melting method, may be used, or a levitation melting method or the like may be used. Among these methods, a high-frequency induction melting method or a levitation melting method is preferably used. In the high-frequency induction melting method, large quantities can be melted at a time. On the other hand, in the levitation melting method, since a molten metal is floated and melted, it is possible to further suppress mixture of impurities from a crucible or the like. The melting atmosphere is preferably a vacuum atmosphere or an inert atmosphere. The inert atmosphere is a gas atmosphere that does not affect the alloy composition, and for example, may be a nitrogen atmosphere, a helium atmosphere, or an argon atmosphere. Among these, use of an argon atmosphere is preferable. The casting method is not particularly limited. For example, a metal mold casting method, a low-pressure casting method, or the like may be used, or a die casting method, such as a common die casting method, a squeegee casting method, or a vacuum die casting method, may be used. Furthermore, a continuous casting method may be used. The mold used for casting can be made of pure copper, a copper alloy, alloy steel, or the like. In the melting and casting step, the content of Fe, S, and P acting as impurities is preferably limited to less than 0.01% in terms of mass ratio.

(2) Homogenizing Treatment Step

In this step, a treatment is performed in which, by dissolving Be (or Be compounds) and Co (or Co compounds) in the Cu matrix, a copper alloy is produced in which dislocations are not generated in crystal grains. Specifically, the resulting ingot is heated and held in a predetermined homogenizing treatment atmosphere, within a predetermined homogenizing temperature range, for a predetermined homogenizing time, and thereby non-uniform structures, such as segregation occurring in a non-equilibrium manner during casting, which may adversely affect subsequent processes, are removed to perform homogenization. The homogenizing atmosphere is preferably a vacuum atmosphere or an inert atmosphere, as in the melting atmosphere. The homogenizing temperature range is preferably 710° C. to 850° C. The reason for this is that at 700° C. or lower, there is a possibility that a grain boundary reaction will take place, and at 860° C. or higher, melting may start depending on the amount of Be. The homogenizing treatment time is preferably 1 to 24 hours, and more preferably 2 to 12 hours. The reason for this is that the time of less than 1 hour is not sufficient to promote diffusion of Be solute atoms, and even when the time exceeds 24 hours in which adequate diffusion is completed, no further effect can be expected.

(3) Pre-working Step

In this step, the ingot which has been subjected to homogenizing treatment is worked into a desired size and shape to obtain a pre-worked material. Specifically, for example, the ingot may be cold- or hot-rolled into a plate. Furthermore, for example, the ingot may be cold- or hot-forged into a rectangular parallelepiped bulk material. Furthermore, in the resulting plate or bulk material, oxide films formed on the surface thereof may be removed by cutting or the like.

(4) Solution Annealing Treatment Step

In this step, the pre-worked material is solution-annealed to obtain a solution-annealed material in which Be (or Be compounds) and Co (or Co compounds) are dissolved in the Cu matrix. Specifically, for example, the pre-worked material may be heated and held in a predetermined solution annealing atmosphere, within a predetermined solution annealing temperature range, for a predetermined solution annealing time, and then cooling may be performed by water cooling, air cooling, or natural cooling such that the surface temperature of the copper alloy is, for example, 20° C. or lower. The solution annealing atmosphere is preferably a vacuum atmosphere or an inert atmosphere, as in the melting atmosphere. The solution annealing temperature range is preferably 710° C. to 860° C. The reason for this is that at 700° C. or lower, there is a possibility that a grain boundary reaction will take place, and at 860° C. or higher, melting may start depending on the amount of Be. In particular, the temperature range is more preferably 790° C. to 850° C. The reason for this is that, by selecting such a high temperature range, it is possible to form a state of more highly supersaturated solid solution. The solution annealing time is preferably 1 minute to 3 hours, and more preferably 1 minute to 1 hour. The solution annealing time depends on the shape and size of the pre-worked material. Even in the case of thin plates or bars and wires, if the solution annealing time is less than one minute, it is not possible to sufficiently dissolve Be solute atoms. Even in the case of large bulk materials, if the solution annealing time exceeds 3 hours, promotion of solid solution cannot be further expected, and coarsening of crystal grains occurs markedly. The cooling rate is preferably set at −55° C./s or more (more preferably −200° C./s or more). When the cooling rate is −55° C./s or more, it is possible to reduce the possibility of occurrence of a grain boundary reaction (discontinuous precipitation of Cu—Be compounds in grain boundaries) and precipitation of Cu—Co-based compounds during cooling. When the cooling rate is −200° C./s or more, occurrence of a grain boundary reaction can be further suppressed. In the solution-annealed material thus obtained, the number of Cu—Co-based compound particles having a particle size of 0.1 μm or more that can be confirmed on a TEM image at a magnification of 20,000 is five or less in a field of view of 10 μm×10 μm.

(5) Cold working step

In this step, the solution-annealed material is subjected to strong working under cold conditions to obtain a cold-worked material. Specifically, for example, the solution-annealed material may be cold-rolled into a rolled material. Furthermore, for example, the solution-annealed material may be cold-forged into a forged material. By performing strong working under cold conditions, structure refinement is possible, and thereby, it is possible to further increase mechanical strength. Structure refinement may occur in the following manner: for example, the structure constituting crystal grains in which the grain boundary inclination angle measured by an OIM (orientation imaging microscopy) method using SEM-EBSD is 2° or more is elongated in one or two directions by strong deformation and is refined in a direction other than these directions; the structure is refined by a dislocation cell newly generated in crystal grains; the structure is refined by a shear transformation zone introduced into crystal grains; or the structure is refined by a deformation twin generated in crystal grains.

In the case where the solution-annealed material is worked into a rolled material, for example, a method can be employed, in which using a solution-annealed material obtained by solution-annealing a pre-worked material worked into a plate, rolling is performed with a pair of upper and lower rolls or more rolls. Specific examples of the rolling method include compression rolling, shear rolling, and the like. These can be used alone or in combination. The term "compression rolling" refers to rolling in which a compressive force is applied to an object to be rolled to generate compression deformation. Furthermore, the term "shear rolling" refers to rolling in which a shear force is applied to an object to be rolled to generate shear deformation. In an example of a method of compression rolling, in the case where rolling is performed using a pair of upper and lower rolls, rolling is performed such that each of the friction coefficient between contact surfaces of the upper roll and the ingot and the friction coefficient between contact surfaces of the lower roll and the ingot becomes minimum. In this case, for example, preferably, the friction coefficient between the upper roll and the ingot is 0.01 to 0.05, the friction coefficient between the lower roll and the ingot is 0.01 to 0.05, and the difference in friction coefficient between the upper roll side and the lower roll side is 0 to 0.02. Furthermore, preferably, the rotational speed of the upper roll is nearly equal to the rotational speed of the lower roll. In such compression rolling, since uniform rolling deformation is easily generated, good rolling accuracy can be achieved. In an example of a method of shear rolling, in the case where rolling is performed using a pair of upper and lower rolls, rolling is performed such that a difference in friction state is provided between the contact surfaces of the upper roll and the ingot and the contact surfaces of the lower roller and the ingot. Examples of the method for providing a difference in friction state include a differential speed rolling method in which a pair of upper and lower rolls rotate at different speeds, and a method in which rolling is performed such that the interfaces between the pair of rolls and the ingot have different friction coefficients. In this case, for example, preferably, the friction coefficient between the upper roll and the ingot is 0.1 to 0.5, the friction coefficient between the lower roll and the ingot is 0.01 to 0.2, and the difference in friction coefficient between the upper roll side and the lower roll side is 0.15 to 0.5. Here, the friction coefficient $\mu$ can be represented by $\mu=G/RP$, where G (Nm) is the drive torque applied to the rolling mill roll, R (m) is the radius of the roll, and P (N) is the rolling load. Since such shear rolling is particularly suitable for rolling with a high working ratio, the structure can be refined by strong working. Furthermore, by refining the structure, mechanical strength can be further increased. In the compression rolling and the shear rolling, the material and the shape of the upper and lower rolls are not particularly limited as long as the intended friction state can be obtained. For example, the material and the shape of the rolls may be selected such that a flat plate can be obtained or a plate having a deformed cross section, such as an irregular cross section or a tapered cross section, can be obtained. The rolling pass conditions are not particularly limited. For example, by performing rolling multiple times, rolling may be continued until the final thickness is obtained. In such a manner, fracture is unlikely to occur during rolling. When rolling is performed, preferably, a plate is rolled under cold conditions such that the rolling reduction is 90% or more. The reason for this is that when the rolling reduction is increased, the structure is refined, and mechanical strength can be further increased. The rolling reduction may be less than 100%, and is preferably 99.99% or less in view of working. The rolling reduction (%) is the value obtained by calculating the formula: {(thickness before rolling—thickness after rolling)×100}÷(thickness before rolling). The rolling speed is not particularly limited, but is preferably 1 to 100 m/min, and more preferably 5 to 20 m/min. The reason for this is that a rolling speed of 5 m/min or more allows efficient rolling, and a rolling speed of 20 m/min or less more reliably suppresses fracturing and the like during rolling.

In the case where the solution-annealed material is worked into a forged material, for example, a method can be employed, in which using a solution-annealed material obtained by solution-annealing a pre-worked material worked into a bulk material, while cooling to remove heat, forging is performed in the X-axis, Y-axis, and Z-axis directions, which are orthogonal to each other, of the bulk material. Regarding the order of forging, preferably, a pressure is applied progressively from the axis direction corresponding to the longest side among the sides of the bulk material. Specifically, a pressure can be applied to the bulk material in each axis direction, using a forging device or the like. Preferably, cooling is performed for each application of pressure such that the surface temperature of the bulk material is maintained at 120° C. or lower (more preferably in the range of 20° C. to 100° C.) during application of pressure. When the surface temperature exceeds 120° C., a shear band structure crossing a plurality of crystal grains is likely to be generated. Therefore, cracks, fracture, and the like occur, which makes it impossible to maintain the shape before working. The pressure applied depends on the amount of reduction and the number of applications of pressure. Preferably, the amount of reduction and the number of applications of pressure are set so that the pressure applied is 1,200 MPa or less. A pressure applied of 1,200 MPa or less does not lead to an increase in the size of the forging device. The amount of reduction (working ratio (%)) in one application of pressure is in the range of 14% to 33%, and the amount of plastic strain (amount of strain; $\varepsilon$) applied to the bulk material in one application of pressure is preferably in the range of 0.15 to 0.36. The "amount of reduction" is the ratio obtained by dividing the amount of work deformation by the original height (working ratio), and is expressed by the formula: amount of strain $\varepsilon=\ln(1-\text{working ratio})$. The cooling method may be any of air cooling, water cooling, and natural cooling. In view of efficiency and productivity of repeated operations, cooling by water cooling is preferable. The cooling is performed in order to cool the heat generated from the bulk material by application of pressure, and is performed such that the surface temperature of the bulk material is preferably 120° C. or lower, more preferably 20° C. to 30° C. (approximately the atmospheric temperature throughout the year). Such treatment is repeated until the cumulative strain $\Sigma\Delta\varepsilon$, which is the cumulative value of the amounts of plastic strain applied to the bulk material, reaches a predetermined value. The cumulative strain $\Sigma\Delta\varepsilon$ is preferably 2.0 or more, and more preferably 2.4 or more. The reason for this is that mechanical strength can be further increased.

Figure 1B:
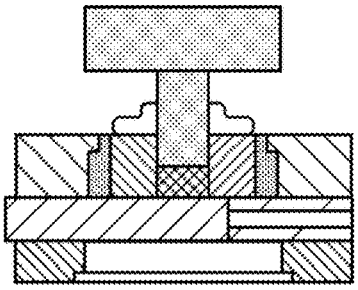
Figure 1B:
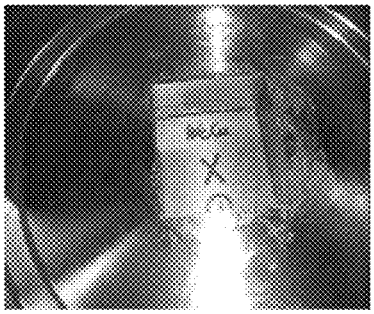
Figure 1C:
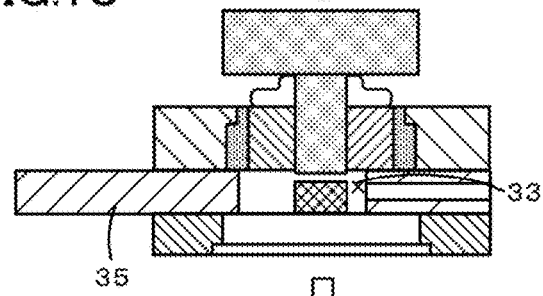
Figure 1C:
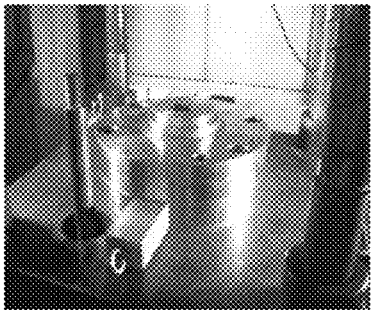
Figure 1D:
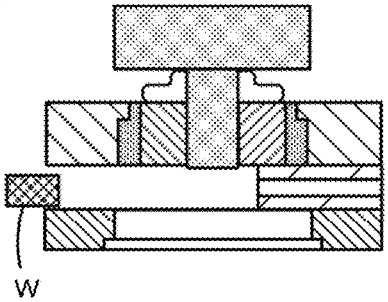
Figure 1D:
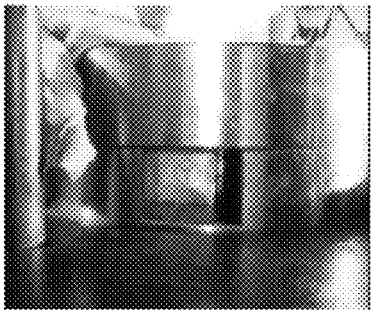

An example of such a forging method will be described below with reference to the drawings. FIG. 1A, FIG. 1B, FIG. 1C and FIG. 1D include explanatory views showing an example of the forging method. In this forging method, a forging die 20 is used. The forging die 20 is used in a forging method in which by deforming a work (bulk material) having a first shape, which is a rectangular hexahedron, into the work having a second shape, which is a rectangular hexahedron, plastic strain is applied to the work. The forging die 20 includes an upper die 21 which press-deforms a work W from above and a lower die 30 which holds the work W in a work space 45 which is a rectangular parallelepiped space. The forging method includes, for example, a placement step of placing a work W having a first shape, which is a rectangular hexahedron (rectangular parallelepiped), in the work space 45 of the forging die 20, and a working step of applying plastic strain to the work W by deforming the placed work into a second shape which is a rectangular hexahedron, in which the placement step and the working step are performed two or more times. In FIG. 1, FIG. 1A is an explanatory view of the placement step, FIG. 1B is an explanatory view of the working step, FIG. 1C is an explanatory view of a push-out step, and FIG. 1D is an explanatory view of a take-out step. In this forging method, a process in which the work W is placed in the work space 45, press-deformed, pushed out, and taken out is performed repeatedly. When the forging die 20 is used, preferably, a lubricant is used on the surface of the work W, a wall portion 54 constituting the work space 45, and the like. That is, the forging treatment may be performed such that a lubricant is interposed between the work W and the forging die 20. As the lubricant, for example, gel (metal soap or the like), powder ($MoS_2$, graphite, or the like), or liquid (mineral oil or the like) can be used. Preferably, the lubricant has high thermal conductivity and does not prevent transfer of processing heat from the work W to the die.

Figure 2:
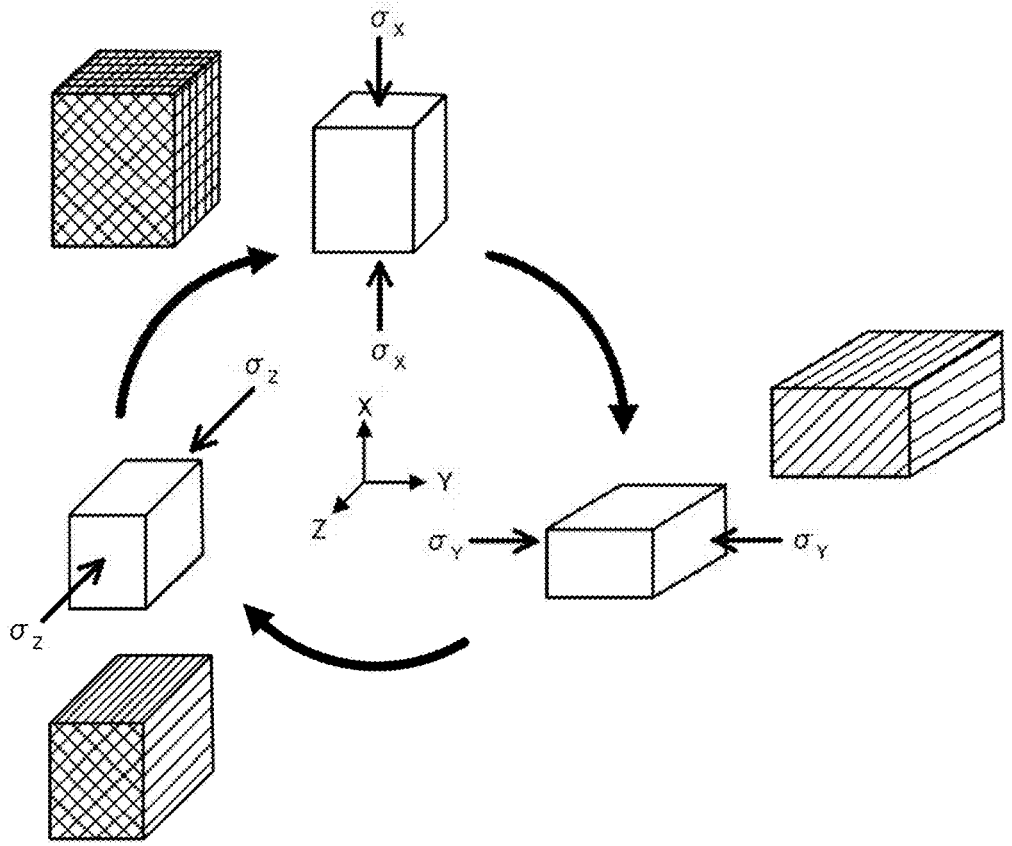
FIG. 2 is an explanatory view showing changes in the work structure due to forging.

In the placement step (FIG. 1A), the work W is placed in the work space 45. In the placement step, it is preferable that the work W be placed while being in contact with any two surfaces of the side wall portion of the work space 45. In such a manner, positional deviation of the work W in the working step can be suppressed, and therefore, plastic strain can be applied to the work W more efficiently. In the working step (FIG. 1B), the work W is deformed with a sufficient pressing force in the work space 45. In the working step, forging is performed in the X-axis, Y-axis, and Z-axis directions, which are orthogonal to each other, of the rectangular parallelepiped. Regarding the order of forging, preferably, a pressure is applied progressively from the axis direction corresponding to the longest side among the sides of the work W. For example, as shown in FIG. 2, the case where the working step is carried out in the order of the X-axis, the Y-axis, and the Z-axis of the work W will be described. The strain rate of the plastic strain applied to the work W is preferably in the range of $1\times10^{-3}$ to $1\times10^{+1}$ ($s^{-1}$), and more preferably in the range of $1\times10^{-2}$ to $1\times10^{+1}$ ($s^{-1}$). In this working step, the work W is preferably deformed such that, for example, the work W having the first shape before deformation and the work having the second shape after deformation have different lengths in each of the X, Y, and Z axes, but the first shape and the second shape are the same. That is, preferably, the ratio of the sides of the work W before deformation is maintained to be the same as that after deformation. In such a manner, equal plastic strain can be applied in each axis direction. In the push-out step (FIG. 1C), a sliding base 35 is slid to form a communicating space 33, and then, the work W in the work space 45 is pushed out to the communicating space 33 by applying pressure from above with an upper die indenter 22. In the take-out step (FIG. 1D), the work W which has been pushed out is taken out of the communicating space 33. For example, the work W is pushed with a pushing bar or the like that is inserted through a through-hole 34 and taken out of the space, from which the sliding base 35 has been removed. At this time, it is preferable to cool the taken out work W. The cooling method may be any of air cooling, water cooling, and natural cooling. In view of efficiency and productivity of repeated operations, cooling by water cooling is preferable. The cooling is performed in order to cool the heat generated from the copper alloy by application of pressure, and is performed such that the surface temperature of the bulk material is preferably 120° C. or lower, and more preferably 20° C. to 30° C. (approximately the atmospheric temperature throughout the year).

In this forging method, the placement step, the working step, the push-out step, and the take-out step are performed until a predetermined number of pressure applications is reached. Here, the term "number of pressure applications" refers to the number of times pressure is applied to the work W in any of the axis directions (X-axis, Y-axis, and Z-axis directions). Furthermore, the term "predetermined number of pressure applications" may refer to the number of times by which the cumulative value of the amounts of plastic strain applied to the copper alloy (cumulative strain $\Sigma\Delta\varepsilon$) reaches, for example, 2.0 or more or 2.4 or more.

In such a forging method, since the work W is press-deformed in the work space 45 of the forging die 20, shape stability can be further secured.

(6) Age Hardening Treatment Step

In this step, by holding the cold-worked material in a predetermined age hardening atmosphere, within a predetermined age hardening temperature range, for a predetermined age hardening time, Be (or Be compounds) contained in the cold-worked material is precipitated, and the material is precipitation hardened. Thus, an age-hardened material is obtained. The age hardening atmosphere is preferably a vacuum atmosphere or an inert atmosphere, as in the melting atmosphere. The age hardening temperature range is preferably 200° C. to 550° C., and more preferably 250° C. to 350° C. Furthermore, the age hardening time is preferably 1 minute to 24 hours, and more preferably 15 minutes to 4 hours. By performing such an age hardening treatment step, it is possible to obtain a Cu—Be alloy having higher mechanical strength.

It is to be understood that the present invention is not limited to the embodiments described above, and various embodiments are possible within the technical scope of the present invention.

For example, in the embodiment described above, the method for producing a Cu—Be alloy includes (1) a melting and casting step, (2) a homogenizing treatment step, (3) a pre-working step, (4) a solution annealing treatment step, (5) a cold working step, and (6) an age hardening treatment step. However, the method may not include all of these steps. For example, the steps (1) to (3), (5), and (6) may be omitted or replaced with other steps. Furthermore, in the cold working step (5), cold rolling and cold forging have been described as examples. However, the cold working is not limited thereto, and for example, cold wire drawing by extrusion, drawing, and the like may be performed.

EXAMPLES

Examples of Cu—Be alloys specifically produced will be described below. Regarding the Cu—Be alloy as a solution-annealed material, all of Experimental Examples 1 to 26 correspond to examples. Furthermore, regarding the Cu—Be alloy as an age-hardened material, Experimental Examples 1 to 6, 10 to 16, and 19 to 23 correspond to examples, and Experimental Examples 7 to 9, 17 to 18, and 24 to 26 correspond to comparative examples.

[Production of Cu—Be Alloy]

Experimental Examples 1 to 6

First, raw materials were weighed such that Be and Co contents were as shown in Table 1 and the balance was Cu, and melting and casting were performed to obtain ingots. The ingots were subjected to homogenizing treatment in which the ingots were held in a nitrogen gas atmosphere at 750° C. for 4 hours. Subsequently, hot rolling was performed in air, at 800° C. to 750° C., at a rolling reduction of 95%, and then cold rolling was performed in air, at room temperature (25° C.), at a rolling reduction of 90%. Furthermore, solution annealing was performed, in which the materials were held in a salt bath at 800° C. for 3 minutes, and then water-cooled at about −400° C./s. Thereby, solution-annealed materials of Experimental Examples 1 to 6 were obtained. The resulting solution-annealed materials were subjected to cold rolling in air, at room temperature (25° C.), at the rolling reduction shown in Table 1. Furthermore, age hardening was performed, in which the cold-rolled materials were held in a nitrogen gas atmosphere, at the temperature and for the time shown in Table 1. Thereby, age-hardened materials were obtained.

reduction in the cold rolling was decreased. Furthermore, in Experimental Example 8, underaging was conducted, and in Experimental Example 9, overaging was conducted.

Comparative Examples 1 to 3

In Comparative Examples 1 to 3, solution-annealed materials and age-hardened materials were obtained as in Experimental Example 1 except that the contents of the raw material, the rolling reduction at cold rolling, and the temperature and time of age hardening were set as shown in Table 1.

Experimental Examples 10 to 16

In these examples, cold forging was performed instead of cold rolling. Specifically, first, raw materials were weighed such that Be and Co contents were as shown in Table 2 and the balance was Cu, and melting and casting were performed to obtain ingots. The ingots were subjected to homogenizing treatment in which the ingots were held in a nitrogen gas atmosphere at 750° C. for 4 hours. Subsequently, hot forging was performed in air, at 800° C. to 750° C., at a cumulative strain $\Sigma\Delta\varepsilon$ of 2.4. Furthermore, solution annealing was performed, in which the materials were held in a nitrogen atmosphere at 780° C. for 3 hours, and then rapidly cooled

TABLE 1

| | Amount of Added Element | | Cu—Co Compound Particles[1)] Particle | | Cold Rolling Rolling | Age Hardening Step | | Mechanical Properties/ Electrical Properties | | | |
|---|---|---|---|---|---|---|---|---|---|---|---|
| | Be mass % | Co mass % | Size μm | Number Number | Reduction % | Temperature ° C. | Time min | UTS MPa | Elongation % | Hardness $MH_v$ | Electrical Conductivity % IACS |
| Experimental Example 1 | 1.91 | 0.041 | 0.3 | 2 | 90 | 315 | 60 | 1740 | 4 | 448 | 25 |
| Experimental Example 2 | 1.61 | 0.031 | 0.3 | 1 | 90 | 315 | 60 | 1700 | 7 | 420 | 26 |
| Experimental Example 3 | 1.88 | 0.005 | 0.2 | 1 | 90 | 315 | 60 | 1720 | 4 | 440 | 25 |
| Exerimental Example 4 | 1.91 | 0.114 | 0.9 | 5 | 90 | 315 | 60 | 1770 | 4 | 452 | 25 |
| Experimental Example 5 | 1.91 | 0.041 | 0.3 | 2 | 90 | 255 | 240 | 1710 | 5 | 422 | 26 |
| Experimental Example 6 | 1.91 | 0.041 | 0.3 | 2 | 90 | 350 | 15 | 1700 | 5 | 418 | 26 |
| Experimental Example 7 | 1.91 | 0.041 | 0.3 | 2 | 85 | 315 | 150 | 1660 | 7 | 420 | 25 |
| Experimental Example 8 | 1.91 | 0.041 | 0.3 | 2 | 90 | 250 | 300 | 1680 | 7 | 418 | 25 |
| Experimental Example 9 | 1.91 | 0.041 | 0.3 | 2 | 90 | 360 | 15 | 1380 | 9 | 398 | 28 |
| Comparative Example 1 | 1.99 | 0.121 | 0.9 | 6 | 90 | 315 | 60 | 1620 | 0.4 | 445 | 25 |
| Comparative Example 2 | 1.83 | 0.127 | 2.2 | 22 | 90 | 315 | 150 | 1480 | 0.7 | 440 | 25 |
| Comparative Example 3 | 1.83 | 0.231 | 2.8 | 19 | 40 | 315 | 150 | 1420 | 0.2 | 425 | 26 |

[1)]The particle size and number of Cu—Co compound particles are average values calculated on the basis of TEM observation in 5 fields of view of 10 μm × 10 μm.

Experimental Examples 7 to 9

In Experimental Examples 7 to 9, the same solution-annealed material as that of Experimental Example 1 was used. Age-hardened materials were obtained as in Experimental Example 1 except that cold rolling was performed at the rolling reduction shown in Table 1, and age hardening was performed at the holding temperature and time shown in Table 1. Note that, in Experimental Example 7, the rolling at about −95° C./s. Thereby, solution-annealed materials of Experimental Examples 10 to 16 were obtained. The resulting solution-annealed materials were subjected to cold forging in air, at room temperature (25° C.), at the cumulative strain $\Sigma\Delta\varepsilon$ shown in Table 2. Furthermore, age hardening was performed, in which the cold-forged materials were held in a nitrogen gas atmosphere, at the temperature and for the time shown in Table 2. Thereby, age-hardened materials were obtained.

TABLE 2

| | Amount of Added Element | | Cu—Co Compound Particles[1)] Particle | | Cold Forging | Age Hardening Step | | Mechanical Properties/ Electrical Properties | | | |
|---|---|---|---|---|---|---|---|---|---|---|---|
| | Be mass % | Co mass % | Size μm | Number Number | ΣΔε — | Temperature ° C. | Time min | UTS MPa | Elongation % | Hardness $MH_v$ | Electrical Conductivity % IACS |
| Experimental Example 10 | 1.91 | 0.041 | 0.3 | 2 | 2.4 | 315 | 60 | 1940 | 2 | 460 | 29 |
| Experimental Example 11 | 1.61 | 0.031 | 0.3 | 1 | 2.4 | 315 | 60 | 1900 | 2 | 455 | 29 |
| Experimental Example 12 | 1.88 | 0.005 | 0.2 | 1 | 2.4 | 315 | 60 | 1920 | 2 | 458 | 29 |
| Experimental Example 13 | 1.91 | 0.114 | 0.9 | 5 | 2.4 | 315 | 60 | 1960 | 1.5 | 467 | 29 |
| Experimental Example 14 | 1.91 | 0.041 | 0.3 | 2 | 2.4 | 255 | 240 | 1930 | 2 | 456 | 29 |
| Experimental Example 15 | 1.91 | 0.041 | 0.3 | 2 | 2.4 | 350 | 15 | 1910 | 2 | 450 | 29 |
| Experimental Example 16 | 1.91 | 0.041 | 0.3 | 2 | 2.0 | 315 | 60 | 1770 | 2 | 447 | 29 |
| Experimental Example 17 | 1.91 | 0.041 | 0.3 | 2 | 2.4 | 250 | 300 | 1550 | 5 | 420 | 28 |
| Experimental Example 18 | 1.91 | 0.041 | 0.3 | 2 | 2.4 | 360 | 15 | 1480 | 6 | 432 | 29 |
| Experimental Example 19 | 1.61 | 0.031 | 0.3 | 1 | 2.0 | 315 | 60 | 1790 | 3.5 | 422 | 30 |
| Experimental Example 20 | 1.88 | 0.005 | 0.2 | 1 | 2.0 | 315 | 60 | 1880 | 2 | 433 | 29 |
| Experimental Example 21 | 1.91 | 0.098 | 0.9 | 5 | 2.0 | 315 | 60 | 1870 | 2 | 442 | 29 |
| Experimental Example 22 | 1.91 | 0.041 | 0.3 | 2 | 2.0 | 255 | 240 | 1850 | 3 | 431 | 29 |
| Experimental Example 23 | 1.91 | 0.041 | 0.3 | 2 | 2.0 | 350 | 15 | 1750 | 3 | 412 | 28 |
| Experimental Example 24 | 1.88 | 0.005 | 0.2 | 3 | 1.93 | 315 | 60 | 1420 | 0.7 | 412 | 28 |
| Experimental Example 25 | 1.91 | 0.098 | 0.9 | 2 | 1.8 | 315 | 60 | 1450 | 0.6 | 423 | 27 |
| Experimental Example 26 | 1.61 | 0.031 | 0.3 | 2 | 1.6 | 315 | 60 | 1270 | 0.9 | 410 | 28 |
| Comparative Example 4 | 1.99 | 0.121 | 0.9 | 6 | 2.4 | 315 | 60 | 1580 | 0.3 | 439 | 29 |
| Comparative Example 5 | 1.83 | 0.127 | 2.2 | 22 | 2.4 | 315 | 150 | 1630 | 0.2 | 452 | 29 |
| Comparative Example 6 | 1.83 | 0.231 | 2.8 | 19 | 2.4 | 315 | 120 | 1520 | 0.6 | 446 | 27 |

[1)]The particle size and number of Cu—Co compound particles are average values calculated on the basis of TEM observation in 5 fields of view of 10 μm × 10 μm.

Experimental Examples 17 and 18

In Experimental Examples 17 to 18, the same solution-annealed material as that of Experimental Example 10 was used. Age-hardened materials were obtained as in Experimental Example 10 except that cold forging was performed at the cumulative strain ΣΔε shown in Table 2, and age hardening was performed at the holding temperature and time shown in Table 2. Note that, in Experimental Example 17, underaging was conducted, and in Experimental Example 18, overaging was conducted.

Experimental Examples 19 to 23

In Experimental Examples 19 to 23, cold forging was performed, as in Experimental Example 16, such that the cumulative strain ΣΔε in the cold forging was 2.0. Specifically, solution-annealed materials and age-hardened materials were obtained as in Experimental Example 16 except that the contents of the raw material, and the temperature and time of age hardening were set as shown in Table 2.

Experimental Examples 24 to 26

In Experimental Examples 24 to 26, cold forging was performed such that the cumulative strain ΣΔε in the cold forging was less than 2.0. Specifically, solution-annealed materials and age-hardened materials were obtained as in Experimental Example 10 except that the contents of the raw material, the cumulative strain in the cold forging, and the temperature and time of age hardening were set as shown in Table 2.

Comparative Examples 4 to 6

In Comparative Examples 4 to 6, solution-annealed materials, cold-forged materials, and age-hardened materials were obtained as in Experimental Example 10 except that the contents of the raw material, the cumulative strain ΣΔε in the cold forging, and the temperature and time of age hardening were set as shown in Table 2.

[TEM Observation]

Figure 3A:
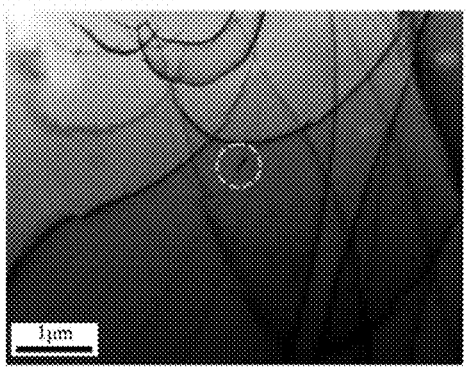
FIG. 3A and FIG. 3B include TEM photographs of a solution-annealed material in Experimental Example 1.
Figure 3B:
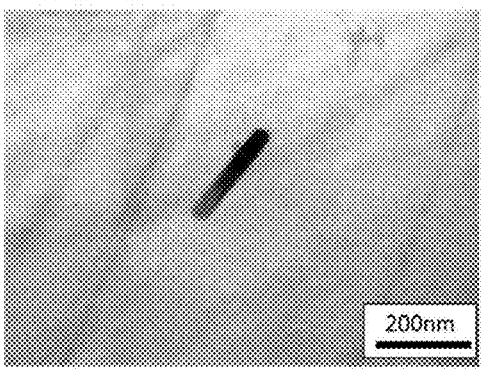
Figure 4:
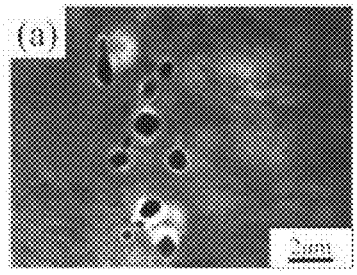
FIG. 4 is a TEM photograph of a solution-annealed material in Comparative Example 3.

TEM observation was performed on the solution-annealed materials of Experimental Examples 1 to 26 and Comparative Examples 1 to 6, and the particle size and number of Cu—Co-based compound particles were measured. The results thereof are shown in Tables 1 and 2. The particle size (average particle size) and number of Cu—Co-based compound particles are average values calculated on the basis of TEM observation in 5 fields of view of 10 μm×10 μm. FIG. 3A and FIG. 3B include TEM photographs of the solution-annealed material of Experimental Example 1. FIG. 4 is a TEM photograph of the solution-annealed material of Comparative Example 3. Note that FIG. 3B is an enlarged view of FIG. 3B. In FIGS. 3 and 4, it was confirmed that the precipitates were Cu—Co-based compounds by elemental analysis using an EDX analysis method. Furthermore, TEM observation was also performed on the age-hardened materials of Experimental Examples 1 to 26 and Comparative Examples 1 to 6, and the particle size and number of Cu—Co-based compound particles were measured. As a result, the shape, the particle size, and the number of Cu—Co-based compound particles were the same as those of the solution-annealed materials.

[Confirmation of Mechanical Properties/Electrical Properties]

UTS (tensile strength) and elongation (elongation at break) were measured in accordance with JIS Z2241. Regarding each of Experimental Examples 1 to 9 and Comparative Examples 1 to 3, three specimens were prepared such that the rolling direction, the width direction, and the 45° direction between the rolling and width directions corresponded to the axis of tension, and the average tensile strength of the specimens was obtained. Furthermore, regarding each of Experimental Examples 10 to 26 and Comparative Examples 4 to 6, six specimens were prepared such that the X-axis direction, the Y-axis direction, the Z-axis direction, the 45° direction between the X and Y directions, the 45° direction between the Y and Z directions, and the 45° direction between the Z and X directions corresponded to the axis of tension, and the average tensile strength of the specimens was obtained. Hardness (micro-Vickers hardness) was measured in accordance with JIS Z2244. Electrical conductivity was obtained in accordance with JIS H0505, in which a volume resistivity ρ of a wire was measured, and the ratio to the resistivity of annealed pure copper (1.7241 μΩcm) was calculated and converted to an electrical conductivity (% IACS). The conversion was performed using the following equation: electrical conductivity γ(% IACS)=1.7241÷volume resistivity ρ×100. The results thereof are shown in Tables 1 and 2.

[Results and Consideration]

As shown in Tables 1 and 2, in the age-hardened materials of Experimental Examples 1 to 6 and Experimental Examples 10 to 16 and 19 to 23, which are obtained by using solution-annealed materials in which the Co content is 0.005% to 0.12% by mass and the number of Cu—Co-based compound particles having a particle size of 0.1 μm or more that can be confirmed on a TEM image at a magnification of 20,000 is five or less in a field of view of 10 μm×10 μm, and being subjected to cold rolling at a rolling reduction of 90% or more or cold forging at a cumulative strain of 2.0 or more, and subsequent appropriate age hardening, a high tensile strength of 1,700 MPa or more is achieved.

In the age-hardened materials, which are obtained using the same solution-annealed material as that of Experimental Example 1, of Experimental Example 7 in which the rolling reduction is low, Experimental Example 8 in which age hardening results in underaging, and Experimental Example 9 in which age hardening results in overaging, and in the age-hardened materials, which are obtained using the same solution-annealed material as that of Experimental Example 10, of Experimental Examples 24 to 26 in which the cumulative strain is small, Experimental Example 17 in which age-hardening results in underaging, and Experimental Example 18 in which age hardening results in overaging, the tensile strength is insufficient. Note that, regarding the solution-annealed materials used in Experimental Examples 7 to 9 and Experimental Examples 17 to 18 and 24 to 26, the strength can be increased if cold working or age hardening is appropriately performed.

In Comparative Example 1 in which, although the Co content is 0.005% to 0.12% by mass, the number of Cu—Co-based compound particles is six or more, in spite of conducting the same cold rolling and age hardening as those in Experimental Example 1, the tensile strength is insufficient. Similarly, in Comparative Example 4 in which, although the Co content is 0.005% to 0.12% by mass, the number of Cu—Co-based compound particles is six or more, in spite of conducting the same cold forging and age hardening as those in Experimental Example 10, the tensile strength is insufficient. As is evident from these results, the number of Cu—Co-based compound particles needs to be five or less. Furthermore, in Comparative Examples 2 and 3 and Comparative Examples 5 and 6 in which the Co content is more than 0.12% by mass, the particle size of Cu—Co-based compound particles is 1 μm or more, the number of the particles is six or more, and the tensile strength is very low. As is evident from these results, in order to obtain a Cu—Be alloy having high mechanical strength, it is necessary at least that the Co content be 0.005% to 0.12% by mass, and the number of Cu—Co-based compound particles having a particle size of 0.1 μm or more that can be confirmed on a TEM image at a magnification of 20,000 be five or less in a field of view of 10 μm×10 μm.

The present application claims priority from Japanese Patent Application No. 2012-242498 filed on Nov. 2, 2012, the entire contents of which are incorporated herein by reference.

INDUSTRIAL APPLICABILITY

The present invention is applicable to electronic contact parts, mechanical structural components, and the like that require high strength, high fracture toughness, and durable reliability.

What is claimed is:

1. A Cu—Be alloy containing Co, wherein the Co content is 0.005% to 0.114% by mass, the Be content is 1.60% to 1.95% by mass, the number of Cu—Co-based compound particles having a particle size of 0.1 μm or more that can be confirmed on a TEM image at a magnification of 20,000 is from one to five in a field of view of 10 μm×10 μm, and wherein the alloy is subjected to a solution annealing treatment step, a cold working step and an age hardening step.

2. The Cu—Be alloy according to claim 1, wherein Cu—Co-based compound particles having a particle size of 1 μm or more are not observed on the TEM image.

3. The Cu—Be alloy according to claim 2, wherein the number of Cu—Co-based compound particles having a particle size of 0.1 μm or more and less than 1 μm that can be confirmed on the TEM image is five or less in a field of view of 10 μm×10 μm.

4. The Cu—Be alloy according to claim 1, wherein the Co content is 0.005% by mass or more and less than 0.05% by mass.

5. The Cu—Be alloy according to claim 1, wherein the Cu—Be alloy is obtained through cold rolling in the cold working step at a rolling reduction of 90% or more or cold forging at a cumulative strain of 2.0 or more and subsequent age hardening treatment in the age hardening step.

6. The Cu—Be alloy according to claim 5, wherein the age hardening treatment is a treatment holding a material for 15 minutes to 4 hours in the temperature range of 250° C. to 350° C.

7. The Cu—Be alloy according to claim 5, wherein the Cu—Be alloy is obtained through solution annealing treatment in the solution annealing treatment step before the cold rolling or the cold forging in the cold working step.

8. The Cu—Be alloy according to claim 1, wherein elongation at break is 1.5% or more.

9. The Cu—Be alloy according to claim 1, wherein the Cu—Be alloy is a solution-annealed material, which has been subjected to solution annealing treatment in the solution annealing treatment step, before being subjected to cold working in the cold working step.

10. A method for producing a Cu—Be alloy including a solution annealing treatment step of subjecting a Cu—Be alloy raw material containing 0.005% to 0.114% by mass of Co and 1.60% to 1.95% by mass of Be to solution annealing treatment to obtain a solution-annealed material, wherein the number of Cu—Co-based compound particles having a particle size of 0.1 μm or more that can be confirmed on a TEM image at a magnification of 20,000 is from one to five in a field of view of 10 μm×10 μm, and wherein the alloy is further subjected to a cold working step and an age hardening step.

11. The method for producing a Cu—Be alloy according to claim 10, wherein, in the cold working step the solution-annealed material is subjected to cold rolling in the cold working step at a rolling reduction of 90% or more or cold forging at a cumulative strain of 2.0 or more to obtain a cold-worked material; and in the age hardening treatment step the cold worked material is held in a temperature range of 250° C. to 350° C., for 15 minutes to 4 hours, to obtain an age-hardened material.

12. The method for producing a Cu—Be alloy according to claim 10, wherein the Cu—Be alloy raw material contains 0.005% by mass or more and less than 0.05% by mass of Co.

13. A Cu—Be alloy containing Co, wherein the Co content is 0.005% to 0.114% by mass, the number of Cu—Co-based compound particles having a particle size of 0.1 μm or more that can be confirmed on a TEM image at a magnification of 20,000 is five or less in a field of view of 10 μm×10 μm, wherein tensile strength is 1,700 MPa or more, and wherein the alloy is subjected to a solution annealing treatment step, a cold working step and an age hardening step.

* * * * *